United States Patent [19]

Easland

[11] 4,288,941

[45] Sep. 15, 1981

[54] TRICK ROPE HAVING APPEARANCE OF WORKING LASSO

[75] Inventor: James C. Easland, DeSmet, S. Dak.

[73] Assignee: Easland Industries, Inc., DeSmet, S. Dak.

[21] Appl. No.: 134,342

[22] Filed: Mar. 26, 1980

[51] Int. Cl.[3] ..... A63B 69/00

[52] U.S. Cl. ..... 46/47; 403/242; 403/291; 403/347

[58] Field of Search ..... 46/1 G, 47, 51; 272/74, 272/75; 57/202, 234; 403/242, 254, 291, 347, 214, 267, 270; 119/153

[56] References Cited

U.S. PATENT DOCUMENTS

| | | | |
|---|---|---|---|
| 1,818,301 | 8/1931 | Canaday | 46/1 G |
| 1,942,768 | 1/1934 | O'Neil | 46/1 G |
| 1,953,565 | 4/1934 | O'Neil | 46/1 G |
| 1,993,010 | 3/1935 | LaRue . | |
| 2,039,731 | 5/1936 | Martin | 46/51 |
| 2,044,240 | 6/1936 | Daniels | 46/51 |
| 2,223,174 | 11/1940 | Hughes | 272/74 |
| 2,486,609 | 11/1949 | O'Neil | 46/1 G |
| 2,503,567 | 4/1950 | Sweetman | 46/1 G |
| 2,563,533 | 8/1951 | Knox | 46/1 G X |
| 2,643,638 | 6/1953 | Villmer . | |
| 2,771,857 | 11/1956 | Soreghen . | |
| 2,928,206 | 3/1960 | Kuhn | 46/51 |
| 2,968,117 | 1/1961 | Trombly | 46/1 |
| 3,528,194 | 9/1970 | Motluk | 46/51 |
| 4,117,625 | 10/1978 | O'Neil | 46/51 |
| 4,136,866 | 1/1979 | Bowvier | 272/75 |

FOREIGN PATENT DOCUMENTS

| | | |
|---|---|---|
| 1119735 | 12/1961 | Fed. Rep. of Germany . |

*Primary Examiner*—F. Barry Shay

*Attorney, Agent, or Firm*—Merchant, Gould, Smith, Edell, Welter & Schmidt

[57] ABSTRACT

A trick rope toy having a stem (14) which has one end affixed to a continuous loop (12). The other end of stem (14) is affixed to a swiveled handle unit (16) which includes a handle (18) a cylindrical tube (20) and fastener (22). The user rotates the handle (18) in a circular motion causing loop (12) to rotate in horizontal plane. The stem (14) is of a more flexible material than the loop (12) and the stem (14) and loop (12) are joined in a lightweight connection so as not to disturb the over-all balance of the loop (12).

1 Claim, 4 Drawing Figures

FIG. 1
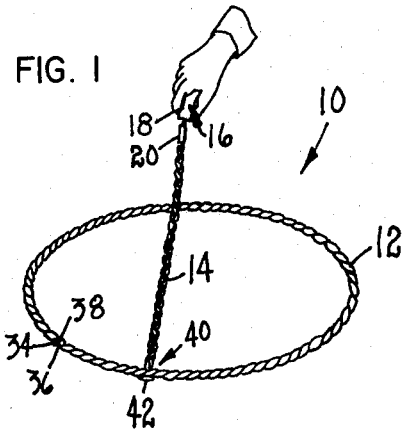
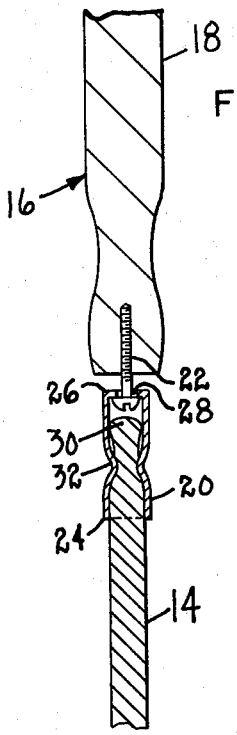
FIG. 2
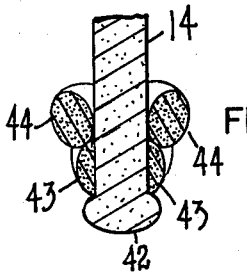
FIG. 4
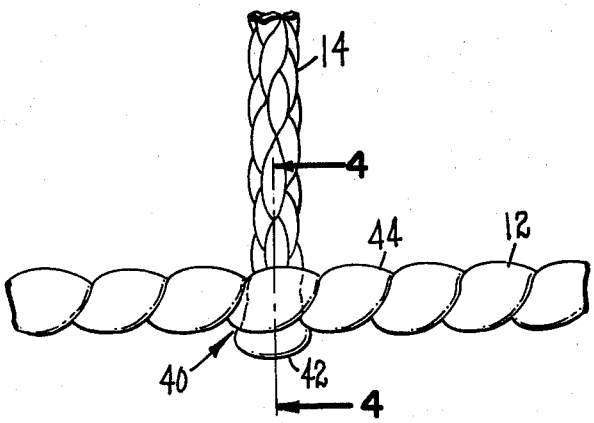
FIG. 3

TRICK ROPE HAVING APPEARANCE OF WORKING LASSO

TECHNICAL FIELD

The present invention relates to the field of toys made with rope such as lariats, hondos and other trick ropes.

BACKGROUND OF THE INVENTION

Lassos and lariats are well known among cattlemen as tools for roping animals. Such devices are generally quite simple consisting of a single rope having a hondo or loop at one end with the rope threaded therethrough creating a noose arrangement. In using the lariat, the looped portion is spun around. Great skill is required to use the lariat in that one must continuously rotate the rope within one's hand by rapid manipulation of the fingers while the lariat is spinning in order to prevent the rope from twisting up. To reduce the difficulty of spinning a lariat so that children may become proficient in a short time, a swivel has been introduced into toy lariats which eliminates the need to rotate the rope. As a toy, the lariat has also been modified to eliminate the noose so as not to strangle anyone by its use. The introduction of means to fix the circumference of the loop has created technical problems with the operation of the toy. The problem arises due to a loss of balance in the loop. U.S. Pat. No. 1,953,565 issued to O'Niel has attempted to solve this problem of balance by locating a plurality of knots spaced around the circumference of the loop to give it a more even weight distribution. This solution, unfortunately, detracts somewhat from the appearance of the toy which is intended to be a replica of a working lasso.

A related problem encountered in prior art trick ropes and lariats has been the inability to spin at high velocity while maintaining proper balance. Even if the loop itself is well balanced, the flexibility of the stem (or rope connecting the loop to the handle) will influence the maximum rate at which the loop may be spun. This problem has not been overcome by prior art.

The present invention provides a safe, inexpensive and high performance trick rope toy which can be operated at high velocity without becoming unstable.

SUMMARY OF THE INVENTION

The present invention comprises a continuous loop of flexible material and a stem of material more flexible than the loop material, the stem being connected at one end to the loop and the other end to a swiveled handle.

According to another feature of the invention, the stem material is interlaced within the loop and the stem is thereafter deformed at its end to prevent it from being withdrawn from within the loop.

According to another feature of the invention, the swiveled handle includes a cylindrical tube sized to receive the end of the stem material, the stem material being rigidified at that end, and the cylindrical tube being deformed so that the stem material may not be withdrawn from the tube due to the tube constriction.

Various advantages and features of novelty which characterize the invention are pointed out with particularity in the claims annexed hereto and forming a part hereof. For a better understanding of the invention, its advantages, and objects obtained by its use, reference should be had to the drawings which form a further part hereof, and to the accompanying descriptive matter, in which there are illustrated and described preferred embodiments of the invention.

BRIEF DESCRIPTION OF THE DRAWINGS

Referring to the drawings, wherein like numerals indicate like elements:

FIG. 1 is an elevational view of the present invention;

FIG. 2 is a fragmentary sectional elevation showing the handle and the means for connecting same to the stem;

FIG. 3 is a fragmentary sectional elevation showing the connection between the stem and the loop;

FIG. 4 is a view taken along line 4—4 of FIG. 3.

DETAILED DESCRIPTION OF THE INVENTION

Referring to the drawings in detail, there is shown in FIG. 1 a trick rope generally designated by the numeral 10, having a loop 12, a stem 14 and a swiveled handle unit 16.

The swiveled handle unit 16 is shown in greater detail in FIG. 2. Handle unit 16 includes handle 18 which is preferably made of plastic or wood, cylindrical tube 20 and fastener 22. Tube 20 preferably made of a rigid material such as steel which can be deformed and thereafter retain its deformed shape. Tube 20 has one end 24 and another end 26. At end 26 there is found an aperture 28 of diameter preferably larger than that of fastener 22. This permits fastener 22 to not only rotate freely but to tip from side to side and allow for greater movement of the stem when the toy is operated. The swiveled handle is assembled by inserting fastener 22 through aperture 28 so that the threaded portion of fastener 22 extends away from tube 20 and can be screwed into handle 18.

Stem 14 is preferably made of a flexible polypropylene hollow braid rope. It is possible to use other flexible material; however, meltable plastics have particular advantages. In the case of polypropylene, it can be melted, causing it to rigidify and deform, and can be bonded to produce a solid connector to similar plastics. Stem 14 is melted at end 30 to form a rigidified portion which is inflexible and not easily deformed. This end of stem 14 is inserted within tube 20 and the tube itself is deformed as indicated at numeral 32. By locating deformations 32 approximately midway down the length of tube 20, end 30 of stem 14 cannot be withdrawn from tube 20 past the deformed portion due to its rigidity caused by previous melting process. Thus a solid connection between the handle unit 16 and stem 14 is created.

Loop 12 is preferably a continuous loop of flexible material. In the preferred embodiment, 3-strand twisted braid polypropylene rope has been employed. Each of the three strands is a grouping of twisted filaments. The free ends 34 and 36 of the rope that forms loop 12 of the rope 34 and 36 are joined in end to end abuttment and fused theretogether as shown at numeral 38. It may also be possible to manufacture a continuous rope section without the need for a fusing of ends.

Stem 14 is joined to loop 12 as shown in FIG. 3 at point 40. This end 42 of stem 14 is threaded or interlaced between braids 44 of loop 12 such that stem 14 extends through loop 12 and slightly therebeyond. End 42 is thereafter melted so that it becomes rigidified and deformed slightly and can no longer be withdrawn through braid 44. For optimum joint strength, stem 14 can be interlaced through one of the strands 43, which is split apart for insertion of stem 14. An alternative to deforming and rigidifying end 42 would be to insert adhesive at the points of contact between braid 44 and stem 14 causing rigid connection. It is also possible to affix stem 14 to loop 12 directly without interlacing by the use of adhesives or by fusing both ropes together to form a "T" shaped connection.

By the use of one of the above means of connecting stem 14 to loop 12, it can be appreciated that the balance of loop 12 is not seriously disrupted in that no additional attaching pieces are required to make the bond. By eliminating such attaching pieces it is possible to produce a loop 12 which has weight distribution around its circumference. This is critical when the device is spun at a high rate of speed so that it will not become unstable and fly out of balance.

To produce the optimum device, stem 14 should be chosen such that it is a material more flexible than loop 12. This can be accomplished by the choice of a hollow braid rope for the stem and a twisted rope for the loop which is stiffer than hollow braid. However, it is equally possible to use a lighter gauge rope in the case of this stem as compared to the loop. By making the stem more flexible than the loop, the device can be operated at a higher speed without the speed interfering with the operation of the loop by virtue of the tortional effect of the stem on the loop which would be caused by a stiffer rope.

The optimum device is also produced by choosing a particular stem length relative to the loop diameter. Experimental results have determined that a stem having a length approximately 75% of the diameter of the loop produces the optimum device in terms of ease of operation and stability.

To operate the device, the user grasps handle 18 vertically with the stem downward. The user then rotates his/her hand in a circular direction. The rotations are carried down to the loop and the loop is caused to rotate on a horizontal plane. The loop can thereafter be accelerated to virtually any speed desired and can be moved to verticle or over the head positions. By virtue of the rope stem flexibility and the unique balance of the loop, the user can accelerate the rope to greater speeds without having a rope circumference weight imbalance cause the rotation to become unstable.

Numerous characteristics and advantages of the invention have been set forth in the foregoing description together with the details of the structure and function of the invention, and the novel features thereof are pointed out in the appended claims. The disclosure, however, is illustrative only and changes may be made in detail, especially in matters of shape, size, arrangement of parts, within the principle of the invention, to the full extent intended by the broad general meaning of the terms in which the appended claims are expressed.

It is claimed that:

1. A trick rope toy comprising a continuous loop consisting of flexible material, said loop being of predetermined size and having the appearance of the loop of a working lasso, a stem of flexible material, a swiveled handle rotatably fixed at one end of said stem, means affixing the remaining end of said stem to said loop material without the use of attaching pieces to produce an attached loop having good balance while maintaining said appearance.

* * * * *